United States Patent [19]

Fujino et al.

[11] 4,038,218

[45] July 26, 1977

[54] PROCESS FOR PREPARATION OF POWDERY DETERGENT COMPOSITIONS

[75] Inventors: Takashi Fujino, Yokohama; Makoto Yamanaka, Koganei; Kouichi Yagi, Tokyo, all of Japan

[73] Assignee: Kao Soap Co., Ltd., Tokyo, Japan

[21] Appl. No.: 672,472

[22] Filed: Mar. 31, 1976

[30] Foreign Application Priority Data

Apr. 14, 1975 Japan ..... 50-45063

[51] Int. Cl.[2] ..... C11D 1/14; C11D 1/72; C11D 3/28

[52] U.S. Cl. ..... 252/542; 252/89 R; 252/110; 252/117; 252/135; 252/524; 252/528; 252/532; 252/539; 252/547; 252/550; 252/558

[58] Field of Search ..... 252/89, 135, 524, 532, 252/542, 551, 539, 528; 260/290 R, 290 B, 293.55, 293.63, 293.67, 293.69, 293.73, 293.83, 293.89

[56] References Cited

U.S. PATENT DOCUMENTS

| | | | |
|---|---|---|---|
| 3,303,135 | 2/1967 | Goldwasser | 252/524 |
| 3,403,107 | 9/1968 | Mylerly | 252/524 |
| 3,640,928 | 2/1972 | Murayama et al. | 260/23 XA |
| 3,679,611 | 7/1972 | Gerecht | 252/542 |
| 3,799,880 | 3/1974 | Kelly et al. | 252/110 |

FOREIGN PATENT DOCUMENTS

| | | |
|---|---|---|
| 704,074 | 2/1965 | Canada |

*Primary Examiner*—P.E. Willis, Jr.
*Attorney, Agent, or Firm*—Blanchard, Flynn, Thiel, Boutell & Tanis

[57] ABSTRACT

A process for the preparation of powdery detergent compositions having an improved spray-drying property, in which there is incorporated in a detergent slurry containing a surface active agent having the formulas (I) or (II):

$$R_1—O—(CH_2CH_2O)_nH \quad (I)$$

or $$R_1—O—(CH_2CH_2O)_nSO_3M \quad (II)$$

wherein $R_1$ is alkyl having 6 to 24 carbon atoms or alkylphenyl in which the latter alkyl has 6 to 18 carbon atoms, $n$ is a number of 1 to 29, M is hydrogen, alkali metal or alkaline earth metal, at least about 0.05 part, per 100 parts of said surface active agent, of a compound having the formula (III) or an acid addition salt thereof:

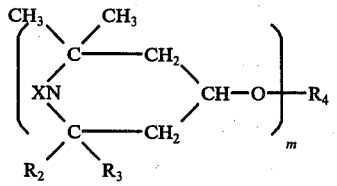

(III)

wherein X is hydrogen or oxygen, $m$ is an integer of 1 to 3, $R_2$ and $R_3$, which can be the same or different, are alkyls having 1 to 12 carbons atoms, or

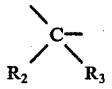

is a 5- to 7-membered saturated aliphatic group or a group of the formula

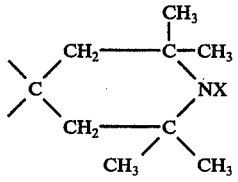

and $R_4$ is a group selected from an organic group and a radical obtained by removing OH group from an inorganic acid, the valency of which is within the range of 1 to 3 depending on the value of $m$.

9 Claims, No Drawings

PROCESS FOR PREPARATION OF POWDERY DETERGENT COMPOSITIONS

BACKGROUND OF THE INVENTION

1. Field of the Invention

The present invention relates to a process for the preparation of powdery detergent compositions having an improved spray-drying property, and the resulting powder detergent composition. More particularly, the invention relates to an improved powdery detergent composition which has been prepared by the spray-drying method and which comprises as the principal water-soluble organic surfactant component a polyoxyethylene alkyl ether, a polyoxyethylene alkylaryl ether, a sulfuric acid ester salt thereof or a mixture thereof.

2. Description of the Prior Art

A powdery detergent composition comprising as the main water-soluble organic surfactant component a polyoxyethylene alkyl ether, a polyoxyethylene alkylaryl ether, a sulfuric acid ester salt thereof or a mixture thereof, contains, in general, form 2 to 30% by weight of such surfactant and in addition, according to need, other conventional ingredients for laundry detergent compositions, including other water-soluble organic surfactants, inorganic or organic builders or chelating agents, a re-contamination-preventing agent, a diluent or extender, a fluorescent whitening agent, a foaming assistant, a perfume, an enzyme and a bleaching agent.

As the other water-soluble organic surfactant, there are generally employed anionic surfactants such as sodium alkylbenzenesulfonates, sodium alkyl sulfates and sodium α-olefinsulfonates. As the water-soluble organic or inorganic builders or chelating agents, there are used condensed phosphoric acid salts such as sodium tripolyphosphate, sodium metasilicate, sodium carbonate, citric acid and its salts, ethylenediamine tetraacetate and sodium nitrilotriacetate. As the re-contamination-preventing agent, there have heretofore been used carboxymethyl cellulose, polyethylene glycol, polyacrylic acid and its salts, and polyvinyl pyrrolidone.

These powdery detergent compositions are conventionally prepared by spraying into a hot gas stream an aqueous slurry containing the desired components at a solid content of about 60 to about 70% by weight. The powder detergent composition products obtained generally contain several weight percent of water.

However, a detergent composition comprising a polyoxyethylene alkyl ether, a polyoxyethylene alkylaryl ether, a sulfuric acid ester salt thereof or a mixture thereof, tends to generate a dense white smoke during the spray-drying step, and a serious problem of air pollution readily occurs.

Generation of this white smoke is due to combustion of the polyoxyethylene akyl ether, polyoxyethylene alkylaryl ether, or sulfuric acid ester salt thereof, or mixtures thereof, under the severe conditions present in a spray drier. As a procedure for overcoming this problem, there has been proposed a method in which the spray-drying is conducted in the presence of a specific phenolic compound or aromatic amine. This method, however, is not satisfactory because the dried detergent particles are discolored and this reduces drastically the commercial value of the detergent product.

SUMMARY OF THE INVENTION

We have discovered that these defects of the conventional techniques can be overcome by adding a compound or a mixture of compounds of the below-mentioned formula III to an aqueous detergent slurry containing a polyoxyethylene alkyl ether, or a polyoxyethylene alkylaryl ether, or a sulfuric acid ester salt, or a mixture thereof, and effecting spray-drying. The resulting spray-dried detergent particles are not discolored at all and an excellent effect of preventing generation of white smoke is attained. Based on this finding, we have now completed the present invention.

In accordance with the present invention, there is provided a process for the preparation of powdery detergent compositions having an improved spray-drying property, characterized by incorporating in an aqueous detergent slurry containing one or more water-soluble organic surfactants having the formula (I) or formula (II):

$$R_1—O—(CH_2CH_2O)_nH \quad (I)$$

or $$R_1—O—(CH_2CH_2O)_nSO_3M \quad (II)$$

wherein $R_1$ is alkyl having 6 to 24 carbon atoms or alkylphenyl in which the latter alkyl has 6 to 18 carbon atoms, $n$ is a number of 1 to 29, M is hydrogen, alkali metal or alkaline earth metal, at least about 0.05 part by weight, per 100 parts by weight of said surfactant of formula I or formula II, of a compound or mixture of compounds having the formula III or acid addition salts thereof:

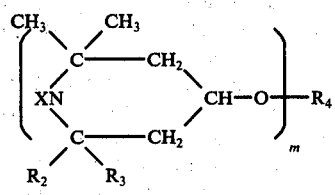

(III)

wherein X is hydrogen or oxygen; $m$ is an integer of 1 to 3; $R_2$ and $R_3$, which can be the same or different, are alkyls having 1 to 12 carbon atoms, or

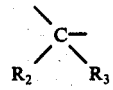

is cycloalkylidene having 5 to 7 carbon atoms or a group having the formula

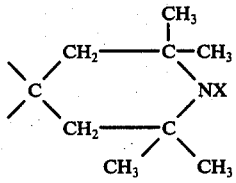

and $R_4$ is a group selected from an organic group and a radical obtained by removing OH group from an inorganic acid, the valency of which is within the range of 1 to 3 according to the value of $m$.

The compound of formula III that is used in the present invention is a stable free radical or a precursor readily convertible to a stable free radical.

In formula III, $R_2$ and $R_3$ are alkyls having 1 to 12 carbon atoms, preferably 1 to 4 carbon atoms, such as methyl, ethyl, isopropyl, butyl, pentyl, hexyl, octyl, nonyl, decyl and dodecyl groups, or they can form, together with the carbon atom to which they are bonded, a cycloalkylidene having 5 to 7 carbon atoms such as cyclopentylidene

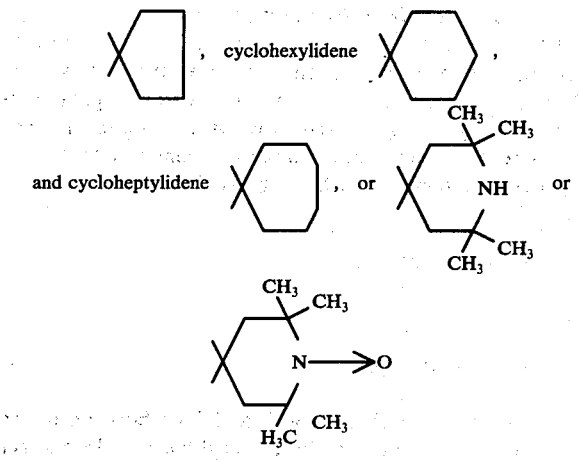

$R_4$ is a group selected from an organic group and a radical obtained by removing OH group from an inorganic acid, the valency of which is within the range of 1 to 3 according to the value of *m*. Specific examples of the group $R_4$ are as follows: In case of $m = 1$:

Acyl groups such as acetyl, propionyl, butyryl, stearoyl, acryloyl, benzoyl, phenoxyacetyl, cyclohexanoyl, o-, m- and p-chlorobenzoyl, o-, m- and p-toluoyl, isonicotinoyl, furoyl and α-naphthoyl groups; N-substituted carbamoyl groups such as ethylcarbamoyl, n-butylcarbamoyl, cyclohexylcarbamoyl, phenylcarbamoyl, o-, m- and p-chlorophenylcarbamoyl, o-, m- and p-tolylcarbamoyl and α-naphthylcarbamoyl groups; N-substituted thiocarbamoyl groups such as ethylthiocarbamoyl, n-butylthiocarbamoyl, cyclohexylthiocarbamoyl and phenylthiocarbamoyl groups; alkyl groups such as methyl, ethyl, n-butyl, octyl and stearyl groups; cycloalkyl groups such as cyclopentyl, cyclohexyl and cycloheptyl groups; aralkyl groups such as benzyl and phenethyl; aryl groups such as phenyl, o-, m- and p-chlorophenyl, o-, m- and p-tolyl and naphthyl groups; 2,2,6,6-tetramethyl-4-piperidyl group; and monovalent radicals obtained by removing an OH group from an acid selected from the group consisting of benzenesulfinic acid, benzenesulfonic acid, p-toluenesulfonic acid, p-n-dodecylbenzenesulfonic acid, methanesulfonic acid, boric acid and phosphoric acid. In case of $m = 2$:

Diacyl groups such as carbonyl, oxalyl, malonyl, adipyl, fumaryl, hexahydroterephthalyl and terephthalyl groups; alkylene groups such as methylene, ethylene, propylene and hexamethylene groups; p-phenylene; p-xylylene; dicarbamoyl groups such as tolylene-2,4-dicarbamoyl, hexamethylene-1,6-dicarbamoyl, diphenylmethane-p,p'-dicarbamoyl and diphenylether-p,p'-dicarbamoyl groups; and divalent radicals obtained by removing two OH groups from an acid selected from the group consisting of benzene-1,3-disulfonic acid, boric acid and phenylphosphorous acid. In case of $m = 3$:

Triacyl groups such as benzene-1,3,5-tricarbonyl, benzene-1,3,4-tricarbonyl, cyclohexane-1,3,5-tricarbonyl and furan-2,3,4-tricarbonyl groups; tricarbamoyl groups such as benzene-1,3,5-tricarbamoyl group; tristhiocarbamoyl groups such as benzene-1,3,4-tristhiocarbamoyl group; propan-1,2,3-yl, hexan-1,3,6-yl, benzen-1,3,5-yl and benzene-1,3,5-triethylene groups; and trivalent radicals obtained by removing 3 OH groups from an acid selected from the group consisting of trisulfonic acids such as benzene-1,3,5-trisulfonic acid, boric acid, phosphoric acid and phosphorous acid.

When X is hydrogen, there can also be used salts of compounds of above general formula (III) with inorganic acids such as phosphoric acid and carbonic acid and organic acids such as citric acid, stearic acid and benzoic acid.

Typical examples of compounds having the formula (III) are as follows:

4-Acetoxy-2,2,6,6-tetramethylpiperidine, 4-stearoyloxy-2,2,6,6-tetramethylpiperidine, 4-acryloyloxy-2,2,6,6-tetramethylpiperidine, 4-(phenylacetoxy)-2,2,6,6-tetramethylpiperidine, 4-(phenoxyacetoxy)-2,2,6,6-tetramethylpiperidine, 4-cyclohexanoyloxy-2,2,6,6-tetramethylpiperidine, 4-benzoyloxy-2,2,6,6-tetramethylpiperidine, 4-(p-chlorobenzoyloxy)-2,2,6,6-tetramethylpiperidine, 4-(m-chlorobenzoyloxy)-2,2,6,6-tetramethylpiperidine, 4-(o-chlorobenzoyloxy)-2,2,6,6-tetramethylpiperidine, 4-(o-toluoyloxy)- 2,2,6,6-tetramethylpiperidine, 4-isonicotinoyloxy-2,2,6,6-tetramethylpiperidine, 4-(2-furoyloxy)-2,2,6,6-tetramethylpiperidine, 4-(β-naphthoyloxy)-2,2,6,6-tetramethylpiperidine, 4-methoxy-2,2,6,6-tetramethylpiperidine, 4-stearyloxy-2,2,6,6-tetramethylpiperidine, 4-cyclohexyloxy-2,2,6,6-tetramethylpiperidine, 4-benzyloxy-2,2,6,6-tetramethylpiperidine, 4-phenoxy-2,2,6,6-tetramethylpiperidine, 4-(ethylcarbamoyloxy)-2,2,6,6-tetramethylpiperidine, 4-(cyclohexylcarbamoyloxy)-2,2,6,6-tetramethylpiperidine, 4-(phenylcarbamoyloxy)-2,2,6,6-tetramethylpiperidine, 4-(p-chlorophenylcarbamoyloxy)-2,2,6,6-tetramethylpiperidine, 4-(o-tolycarbamoyloxy)-2,2,6,6-tetramethylpiperidine, 4-(α-naphthylcarbamoyloxy)-2,2,6,6-tetramethylpiperidine, 4-(ethylthiocarbamoyloxy)-2,2,6,6-tetramethylpiperidine, 4-(cyclohexylthiocarbamoyloxy)-2,2,6,6-tetramethylpiperidine, 4-(phenylthiocarbamoyloxy)-2,2,6,6-tetramethylpiperidine, 4-benzenesulfinyloxy-2,2,6,6-tetramethylpiperidine, 4-benzensulfonyloxy-2,2,6,6-tetramethylpiperidine, 4-(p-toluensulfonyloxy)-2,2,6,6-tetramethylpiperidine, 4-(p-n-dodecylbenzenesulfonyloxy)-2,2,6,6-tetramethylpiperidine, 4-methanesulfonyloxy-2,2,6,6-tetramethylpiperidine, bis(2,2,-6,6-tetramethyl-4-piperidyl)carbonate, bis(2,2,6,6-tetramethyl-4-piperidyl)oxalate, bis(2,2,6,6-tetramethyl-4-piperidyl)malonate, bis(2,2,6,6-tetramethyl-4-piperidyl)-adipate, bis(2,2,6,6-tetramethyl-4-piperidyl)fumarate, bis(2,2,6,6-tetramethyl-4-piperidyl)hexahydroterephthalate, bis(2,2,6,6-tetramethyl-4-piperidyl)terephthalate, bis(2,2,6,6-tetramethyl-4-piperidyl)tolylene-2,4-dicarbamate, bis(2,2,6,6 -tetramethyl-4-piperidyl)-hexamethylene-1,6-dicarbamate, bis(2,2,6,6-tetramethyl-4-piperidyl)diphenylmethane-p,p'-dicarbamate, bis(2,2,6,6-tetramethyl-4-piperidyl)diphenylether-p,p'-dicarbamate, bis(2,2,6,6-tetramethyl-4-piperidyl)benzene-1,3-disulfonate, bis(2,2,6,6-tetramethyl-4-piperidyl)phenylphosphite, tris(2,2,6,6-tetramethyl-4-piperidyl)phosphite, tris(2,2,6,6-tetramethyl-4-piperidyl)phosphate, bis(2,2,6,6-tetramethyl-4-piperidyl)-ether, tris(2,2,6,6-tetramethyl-4-piperidyl)benzene-1,3,5-tricarboxylate, tris(2,2,6,6-tetramethyl-4-piperidyl)benzene-1,3,4-tricarboxylate, 1,2-bis(2,2,6,6-tetramethyl-4-piperidyloxy)ethane, α,α'-bis(2,2,6,6-tetramethyl-4-piperidyloxy)-p-xylene, 6-aza-7,7-dimethyl-9-benzoyloxyspiro[4,5]decane, 1-aza-2,2,-dimethyl-4-benzoyloxy-spiro-[5,5]undecane, 1,9-diaza-4-benzoyloxy-2,2,8,8,10,10-hexamethyl-spiro[5,5]undecane, and 1,9-diaza-4-cyclohexylcarbamoyloxy)-2,2,8,8,10,10-hexamethyl-spiro[5,5]undecane.

Preferred smoke-preventing agents employed in the present invention include compounds having the following formula (IV):

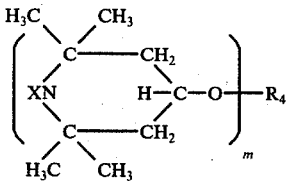

(IV)

wherein X, $m$ and $R_4$ are as defined above in general formula (III).

Typical examples of the compounds represented by above general formula (IV) are as follows:

4-Benzoyloxy-2,2,6,6-tetramethylpiperidine, 4-stearoyloxy-2,2,6,6-tetramethylpiperidine, 4-acetoxy-2,2,6,6-tetramethylpiperidine, 4-(p-chlorobenzoyloxy)-2,2,6,6-tetramethylpiperidine, 4-stearoyloxy-2,2,6,6-tetramethylpiperidine-1-oxide, 4-benzoyloxy-2,2,6,6-tetramethylpiperidine-1-oxide, 4-methoxy-2,2,6,6-tetramethylpiperidine, 4-benzoyloxy-2,2,6,6-tetramethylpiperidine, 4-(ethylcarbamoyloxy)-2,2,6,6-tetramethylpiperidine, 4-(o-tolylcarbamoyloxy)-2,2,-6,6-tetramethylpiperidine, 4-(cyclohexylthiocarbamoyloxy)-2,2,6,6-tetramethylpiperidine, 4-(p-n-dodecylbenzenesulfonyloxy)-2,2,6,6-tetramethylpiperidine, bis(2,2,6,6-tetramethyl-4-piperidyl) carbonate, bis(2,2,6,6-tetramethyl-4-piperidyl)-adipate, bis(2,2,6,6-tetramethyl-4-piperidyl)-terephthalate, bis(2,2,6,6-tetramethyl-4-piperidyl)-tolylene-2,4-dicarbamate, tris(2,2,6,6-tetramethy-4-piperidyl)phoshite, tris(2,2,6,6-tetramethyl-4-piperidyl)-benzene-1,3,5-tricarboxylate, 1,2-bis(2,2,6,6-tetramethyl-4-piperidyloxy)ethane and 1,9-diaza-4-benzoyloxy-2,2,8,8,10,10-hexamethyl-spiro[5,5,]undecane.

The amount of the compound of formula (III) or formula (IV) used as the smoke-preventing agent in the present invention is changed according to such factors as the amount of the surface active agent of formula I or formula II present in the slurry, e.g., a polyoxyethylene alkyl ether, the spray-drying temperature and the time during which the composition is maintained at an elevated temperature. In general, the amount of the smoke-preventing agent is at least about 0.05 part by weight, preferably about 0.3 to about 10 parts by weight, per 100 parts by weight of the surface active agent of above formula (I) or formula (II), such as a polyoxyethylene alkyl ether. The optimum amount of the smoke-preventing agent in a specific embodiment can easily be determined by routine experimentation within the parameter set forth above. The compound of formula III is generally prepared by known processes such as disclosed in U.S. Pat. No. 3 640 928, in lines 43 to 58 of column 5.

The smoke-preventing agent can be introduced into the spray-drying zone by any suitable method. It is, however, convenient to add the smoke preventing agent to the aqueous slurry prior to the spray-drying step.

According to the process of the present invention, generation of smoke can substantially be prevented during the spray-drying step, and the powder or particle of the spray-dried composition has a beautiful white color without discoloration at all.

The present invention will now be further described by reference to the following illustrative Examples that by no means limit the scope of the invention.

It was found that the temperature for initiation of the weight loss after evaporation of free water inthe DTA-TG curve by the differential thermal analysis is completely in agreement with the temperature at which the exothermic reaction is caused to occur during the drying step while generating smoke. Accordingly, in Examples 1 and 2 this temperature for initiation of the weight loss was adopted as the smoking-initiating temperature.

EXAMPLE 1

| | | |
|---|---|---|
| Surface active agent of formula (I) or (II) (listed in Table 1) | X% by weight | sum of X and Y is 15% by weight |
| Other surface active agent (listed in Table 1) | Y% by weight | |
| Sodium tripolyphosphate | | 30% by weight |
| Diatomaceous earth No. 2 | | 10% by weight |
| Sodium sulfate | | 40% by weight |
| Water | | 4% by weight |
| Smoke-preventing agent (listed in Table 2) | | 1% by weight |

Water was added to a mixture having the above composition so that the solid content was 60% by weight. In this manner, 42 detergent slurrys were prepared, each of which had a white appearance.

Table 1

| Sample No. | Kinds and Mixing Ratios of Surface Active Agents | |
|---|---|---|
| | X, % by weight | Y, % by weight |
| 1 | POE(9) alkyl ($C_{12}$, primary) ether, 15% | none |
| 2 | POE(9) alkyl ($C_{13}$, secondary) ether, 15% | none |
| 3 | sodium POE(3) alkyl ($C_{14}$, primary) ether sulfate, 15% | none |
| 4 | sodium POE(3) alkyl ($C_{14}$, secondary) ether sulfate, 15% | none |
| 5 | POE(3) alkyl ($C_{15}$) phenyl ether, 15% | none |
| 6 | POE(9) alkyl ($C_{13}$, secondary) ether, 10% | sodium alkyl ($C_{12}$) benzene sulfonate, 5% |
| 7 | sodium POE(3) alkyl ($C_{14}$, secondary) ether sulfate, 10% | sodium alkyl ($C_{14}$) sulfate, 5% |

Each of the thus-formed slurrys was concentrated so that the water content thereof was reduced to about 5% by weight, and it was then placed on a balance for the differential thermal analysis and dried by elevating the temperature from room temperature (about 25° C) to 400° C. In this manner, the smoking-initiating temperature was determined. The results obtained are listed in Table 2, from which it is seen that composition samples comprising the smoke-preventing agent had a higher smoking-initiating temperature than composition samples free of the agent.

In Table 2, the symbols ⊙, ○, Δ and X indicate the appearance of the powder after the above drying treatment, each mark having the following meaning:

⊙ : white
○ : approximately white
Δ : slightly discolored
X: considerably discolored.

Table 2

| Smoke-Preventing Agent | Compositon Sample No. 1 | 2 | 3 | 4 | 5 | 6 | 7 |
|---|---|---|---|---|---|---|---|
| 4-benzoyloxy-2,2,6,6-tetramethylpiperidine | 225° C ⊙ | 222° C ⊙ | 230° C ⊙ | 226° C ⊙ | 235° C ⊙ | 223° C ⊙ | 228° C ⊙ |
| 4-stearoyloxy-2,2,6,6-tetramethylpiperidine | 236° C ⊙ | 233° C ⊙ | 241° C ⊙ | 236° C ⊙ | 242° C ⊙ | 234° C ⊙ | 237° C ⊙ |
| bis(2,2,6,6-tetramethyl-4-piperidine)adipate | 249° C ⊙ | 246° C ⊙ | 252° C ⊙ | 248° C ⊙ | 250° C ⊙ | 245° C ⊙ | 249° C ⊙ |
| t-butyl-4-hydroxyanisole (comparison) | 273° C X | 243° C X | 225° C X | 234° C X | 264° C X | 241° C X | 234° C X |
| 2,6-di-t-butyl-4-methylphenol (comparison) | 223° C X | 209° C Δ | 219° C Δ | 215° C Δ | 228° C X | 210° C Δ | 215° C Δ |
| not added | 205° C ○ | 190° C ○ | 206° C ○ | 193° C ○ | 210° C ○ | 189° C ○ | 192° C ○ |

EXAMPLE 2

| | |
|---|---|
| Polyoxyethylene(9) alkyl ($C_{13}$, secondary) ether | 15% by weight |
| Sodium tripolyphosphate | 30% by weight |
| Diatomaceous earth No. 2 | 10% by weight |
| Sodium sulfate | 40% by weight |
| Smoking-preventing agent (listed in Table 3) | 1% by weight |
| Water | 4% by weight |

Water was added to a mixture having the above composition so that the solid content was 60% by weight. In this manner, 16 detergent slurrys were prepared. Each slurry was concentrated so that the water content was reduced to about 5% by weight, and it was then placed on a balance for the differential thermal analysis and dried by elevating the temperature from room temperature (about 25° C) to 400° C. Thus, the smoking-initiating temperature was determined to obtain the results shown in Table 3.

EXAMPLE 3

| | |
|---|---|
| Polyoxyethylene(9) alkyl ($C_{12}$, primary) ether | 15% by weight |
| Sodium tripolyphosphate | 30% by weight |
| Diatomaceous earth No. 2 | 10% by weight |
| Sodium sulfate | 40% by weight |
| 4-Benzoyloxy-2,2,6,6-tetramethylpiperidine | 0.1% by weight |
| Water | 4.9% by weight |

Water was added to a mixture having the above composition to form a detergent slurry having a solid content of 60% by weight. The slurry was spray-dried by using a spray drier commerically used for production of powdery detergents. Generation of smoke was scarcely observed during the spray-drying step.

When a slurry prepared in the same manner as above by replacing the 4-benzoyloxy-2,2,6,6-tetramethylpiperidine with water was spray-dried under the same conditions, a very dense white smoke was generated.

The embodiments of the invention in which an exclusive property or privilege is claimed are defined as follows:

1. In a process which comprises spray drying an aqueous slurry of a detergent composition to obtain a powder detergent, wherein said detergent composition consists essentially of from 2 to 30 percent by weight of surfactant selected from the group consisting of surfactants having the formula $R_1—O—(CH_2CH_2O)_nH$, surfactants having the formula $R_1—O—(CH_2CH_20)_n$-$SO_3M$, and mixtures thereof, wherein $R_1$ is alkyl having 6 to 24 carbon atoms or alkyl ($C_6$ to $C_{18}$) phenyl, *n* is a number from one to 29, and M is hydrogen, alkali metal Table 3

| Sample No. | Smoke Preventing Agent | Smoking-Initiating Temperature (° C) | Appearance of Dried Powder |
|---|---|---|---|
| 1 | 4-acetoxy-2,2,6,6-tetramethylpiperidine | 224 | ⊙ |
| 2 | 4-(p-chlorobenzoyloxy)-2,2,6,6-tetramethylpiperidine | 241 | ⊙ |
| 3 | 4-methoxy-2,2,6,6-tetramethylpiperidine | 216 | ⊙ |
| 4 | 4-benzoyloxy-2,2,6,6-tetramethylpiperidine | 223 | ⊙ |
| 5 | 4-(ethylcarbamoyloxy)-2,2,6,6-tetramethylpiperidine | 246 | ⊙ |
| 6 | 4-(o-tolylcarbamoyloxy)-2,2,6,6-tetramethylpiperidine | 238 | ⊙ |
| 7 | 4-(p-n-dodecylbenzenesulfonyloxy)-2,2,6,6-tetramethylpiperidine | 219 | ⊙ |
| 8 | 4-(cyclohexylthiocarbamoyloxy)-2,2,6,6-tetramethylpiperidine | 220 | ⊙ |
| 9 | 1,9-diaza-4-benzoyloxy-2,2,8,8,10,10-hexamethylspiro[5,5]undecane | 229 | ⊙ |
| 10 | bis(2,2,6,6-tetramethyl-4-piperidyl)carbonate | 232 | ⊙ |
| 11 | bis(2,2,6,6-tetramethyl-4-piperidyl)terephthalate | 221 | ⊙ |
| 12 | 1,2-bis(2,2,6,6-tetramethyl-4-piperidyloxy)ethane | 217 | ⊙ |
| 13 | bis(2,2,6,6-tetramethyl-4-piperidyl)tolylene-2,4-dicarbamate | 249 | ⊙ |
| 14 | tris(2,2,6,6-tetramethyl-4-piperidyl)benzene-1,3,5-tricarboxylate | 225 | ⊙ |
| 15 | tris(2,2,6,6-tetramethyl-4-piperidyl)phosphite | 228 | ⊙ |
| 16 | not added | 190 | ○ |

or alkaline earth metal, and the balance of the detergent composition is other conventional ingredients for clothes laundering detergent compositions, the improvement which comprises the step of: incorporating in said aqueous slurry during the spray drying step from 0.05 to 10 parts by weight, per 100 parts by weight of said surfactant, of a smoke-preventing agent of the following formula

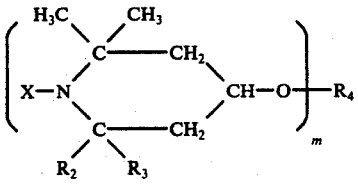

wherein X is hydrogen or oxygen; *m* is an integer of one to 3; $R_2$ and $R_3$, which can be the same or different, are alkyls having one to 12 carbon atoms, or

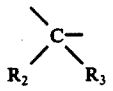

is cycloalkylidene having 5 to 7 carbon atoms, or

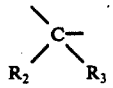

has the formula

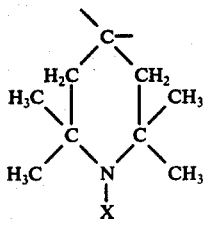

wherein X has the same meaning as defined above, in which; when *m* is one, $R_4$ is acyl, N-substituted carbamoyl, N-substituted thiocarbamoyl, alkyl, cycloalkyl, aralkyl, aryl, 2,2,6,6-tetramethyl-4-piperidyl and monovalent radical obtained by removal of one OH group from an acid selected from the group consisting of benzenesulfinic acid, benzenesulfonic acid, p-toluenesulfonic acid, p-n-dodecybenzenesulfonic acid, methanesulfonic acid, boric acid and phosphoric acid; when *m* is 2, $R_4$ is diacyl, alkylene, p-phenylene, p-xylylene, dicarbamoyl and divalent radical obtained by removing two OH groups from an acid selected from the group consisting of benzene-1,3-disulfonic acid, boric acid and phenylphosphorous acid; and when *m* is 3, $R_4$ is triacyl, tricarbamoyl, tristhio carbamoyl, propan-1,3,5-yl, hexan-1,3,6-yl, benzen-1,3,5-yl, benzene-1,3,5-triethylene and trivalent radical obtained by removing 3 OH groups from an acid selected from the group consisting of trisulfonic acid, boric acid, phosphoric acid and phosphorous acid; and when X is hydrogen, a salt thereof with phosphoric acid, carbonic acid, citric acid, stearic acid or benzoic acid.

2. A process as claimed in claim 1 in which $R_2$ and $R_3$ are alkyl having one to 4 carbon atoms.

3. A process as claimed in claim 1 in which $R_2$ and $R_3$ are methyl.

4. A process as claimed in claim 1 in which the amount of said agent is from 0.3 to 10 parts by weight, per 100 parts by weight of said surfactant.

5. A process as claimed in claim 1, in which the balance of the detergent composition consists essentially of water-soluble, synthetic anionic clothes-washing surfactant different from the ether sulfate, or water-soluble alkaline inorganic builder salt, or water-soluble organic builder, or water-soluble neutral salt, or mixtures thereof.

6. A process as claimed in claim 1 in which the agent is 4-benzoyloxy-2,2,6,6-tetramethylpiperidine.

7. A process as claimed in claim 1 in which the agent is 4-stearoyloxy-2,2,6,6-tetramethylpiperidine.

8. A process as claimed in claim 1 in which the agent is bis(2,2,6,6-tetramethyl-4-piperidine)adipate.

9. A powder detergent composition prepared by the process of claim 1.

* * * * *